US006612871B1

(12) United States Patent
Givens

(10) Patent No.: US 6,612,871 B1
(45) Date of Patent: Sep. 2, 2003

(54) ELECTRICAL CONNECTOR HAVING INTEGRAL NOISE SUPPRESSING DEVICE

(75) Inventor: David F. Givens, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/118,214

(22) Filed: Apr. 5, 2002

(51) Int. Cl.[7] ..... H01R 13/66
(52) U.S. Cl. ..... 439/620
(58) Field of Search ..... 439/607, 941, 439/609, 620, 676

(56) References Cited

U.S. PATENT DOCUMENTS 4,789,847 A * 12/1988 Sakamoto et al. ..... 333/185
5,647,767 A * 7/1997 Scheer et al. ..... 439/620
5,736,910 A * 4/1998 Townsend et al. ..... 333/181
5,759,067 A * 6/1998 Scheer ..... 439/607
5,766,043 A * 6/1998 Talend ..... 439/607

* cited by examiner

*Primary Examiner*—Neil Abrams
*Assistant Examiner*—Phuong Dinh
(74) *Attorney, Agent, or Firm*—Wei Te Chung

(57) ABSTRACT

A modular jack connector includes a housing defining a plug receiving space for receiving a complementary plug connector therein. The housing includes a printed circuit board with a number of first and second terminals mounted thereon. Each first terminal includes a spring arm extending into the plug receiving space. A first noise suppressing device is mounted on the printed circuit board and electrically connecting the first terminals with corresponding second terminals via the printed circuit board. This invention is characterized in that ferrite ceramics are integrally arranged to the second terminals so as to provide an enhanced noise suppressing result.

3 Claims, 2 Drawing Sheets

ELECTRICAL CONNECTOR HAVING INTEGRAL NOISE SUPPRESSING DEVICE

CROSS-REFERENCE OF RELATED APPLICATIONS

This patent application is related to U.S. patent application Ser. No. 10/036,073, filed Oct. 19, 2001, entitled "CONNECTOR ASSEMBLY"; U.S. patent application Ser. No. 10/002,367, filed Nov. 1, 2001, entitled "ELECTRICAL CONNECTOR HAVING CIRCUIT BOARD MOUNTED THEREIN"; and U.S. patent application Ser. No. 10/075,356, filed Feb. 13, 2002, entitled "LAYOUT FOR NOISE REDUCTION ON A PRINTED CIRCUIT BOARD AND CONNECTOR USING IT".

FIELD OF THE INVENTION

The present invention relates to an electrical connector, and more particularly to an electrically connector on which terminals are integrally and electrically arranged with a noise suppressing device thereby providing enhanced noise suppressing performance.

DESCRIPTION OF PRIOR ART

Suppressing noises to as low as possible for high speed signal transmission is a goal for all connector designers and well as system companies. Many suggestions have been provided so as to enhance the signal transmission. For example, RJ type connectors have been widely used in telecommunication. Since terminals in RJ connector are closely arranged thereby creating a high risk of cross-talk which is a killer for high speed signal communication.

U.S. Pat. No. 5,069,641 issued to Sakamoto et al. on Dec. 3, 1991 discloses a modular jack to be mounted on a circuit board and which has a printed circuit board containing a noise suppressing electronic element mounted in a housing. The printed circuit board is fitted with contactors for contacting with plugs and terminals to be used for mounting the modular jack on the printed circuit board. The contactors and the terminals are electrically connected with the noise suppressing electronic element by wires on the printed circuit board.

U.S. Pat. No. 5,736,910 issued to Townsend et al. discloses a modular jack carrying the same idea in which a printed circuit board is disposed within a housing thereof. The printed circuit board carries magnets winding with coil wires to act as a noise suppressing device. As shown in FIG. 5 of Townsend patent, four magnets are incorporated.

U.S. Pat. No. 5,872,492 discloses another solution in which terminals are wound over a core member. It can be readily noticed that the manufacturing process is comparably complicated.

Other measurements include providing a choke or magnet with conductive coils wound thereon. The magnet assembly is further arranged between head and tail portions of a terminal. This provides an acceptable result, however, the manufacturing cost is too high because considerable manual operations have been involved. Even this provide excellent noise suppressing performance, the operation cost is too high for mass production.

Several applications assigned to the common assignee provide an economic solution to the above addressed problem such as those applications disclosed in the cross-reference of related application filed under the common assignee.

Regarding to the performance of the above described device, the maximum level reached is about 9–15 dB. However, in some application, the requirement reaches to 35 dB, and the conventional device can't meet such level.

SUMMARY OF THE INVENTION

It is an object of this invention to provide an electrical connector in which a second noise suppressing device is arranged to the terminal thereby provide enhanced noise suppressing performance.

In order to achieve the object set forth, a modular jack connector in accordance with the present invention includes a housing defining a plug receiving space for receiving a complementary plug connector therein. The modular jack connector includes a printed circuit board with a plurality of first and second terminals mounted thereon. Each first terminal includes a spring arm extending into the plug receiving space. The second terminals are mounted on the other side of the printed circuit board. A first noise suppressing device is mounted on the printed circuit board and electrically connecting the first terminals with corresponding terminals via the printed circuit board. This invention is characterized in that ceramics are integrally arranged to the second terminals so as to provide an enhanced noise suppressing result.

According to one aspect of the present invention, the ferrite ceramic provides a plurality of holes through which terminal tails extend.

BRIEF DESCRIPTION OF THE DRAWINGS

Other objects and further features of the present invention will be apparent from the following detailed description when read in conjunction with the accompanying drawings, in which.

DESCRIPTION OF PREFERRED EMBODIMENT

Figure 1:
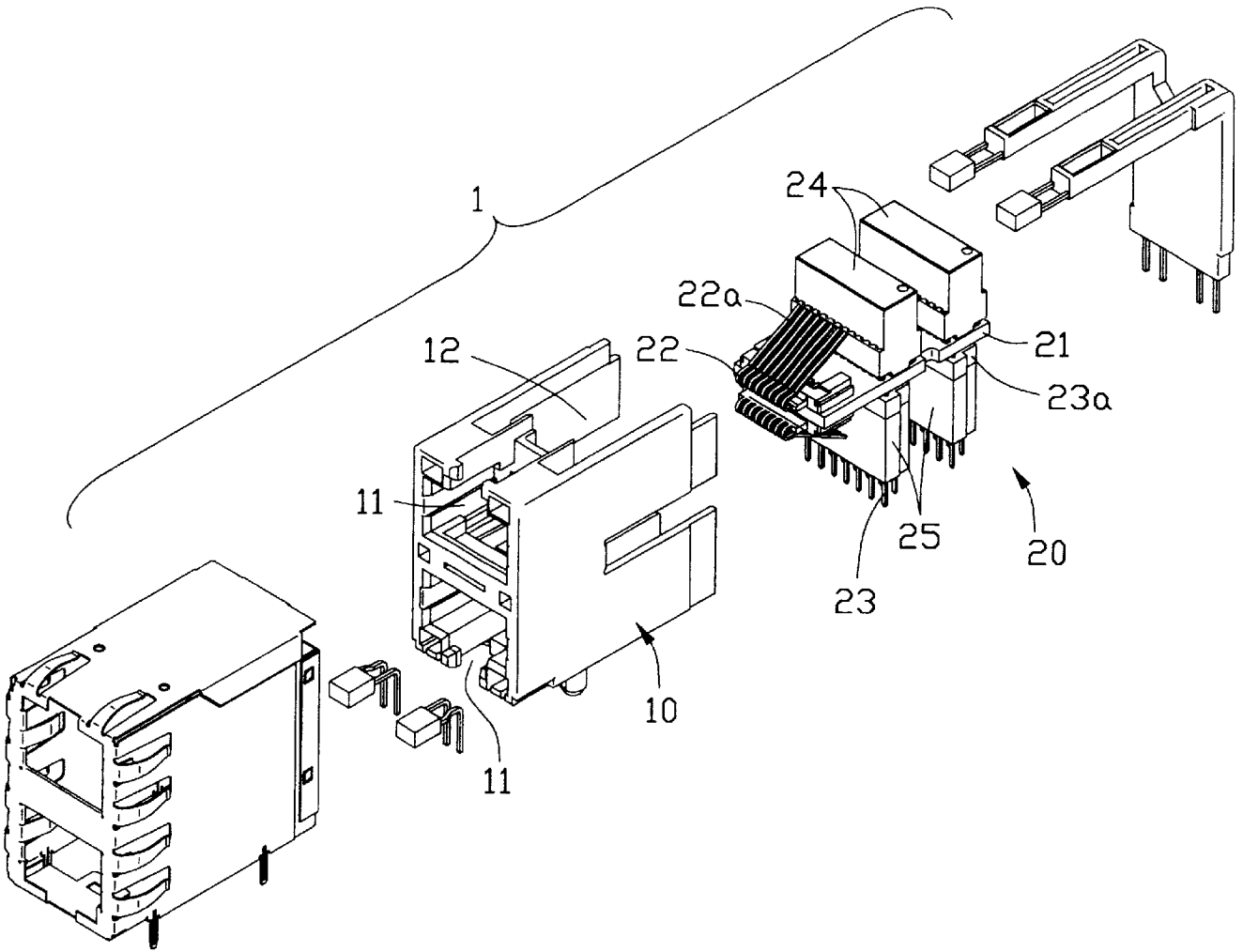
FIG. 1 is an exploded perspective view of an electrical connector in accordance with the present invention.
Figure 2:
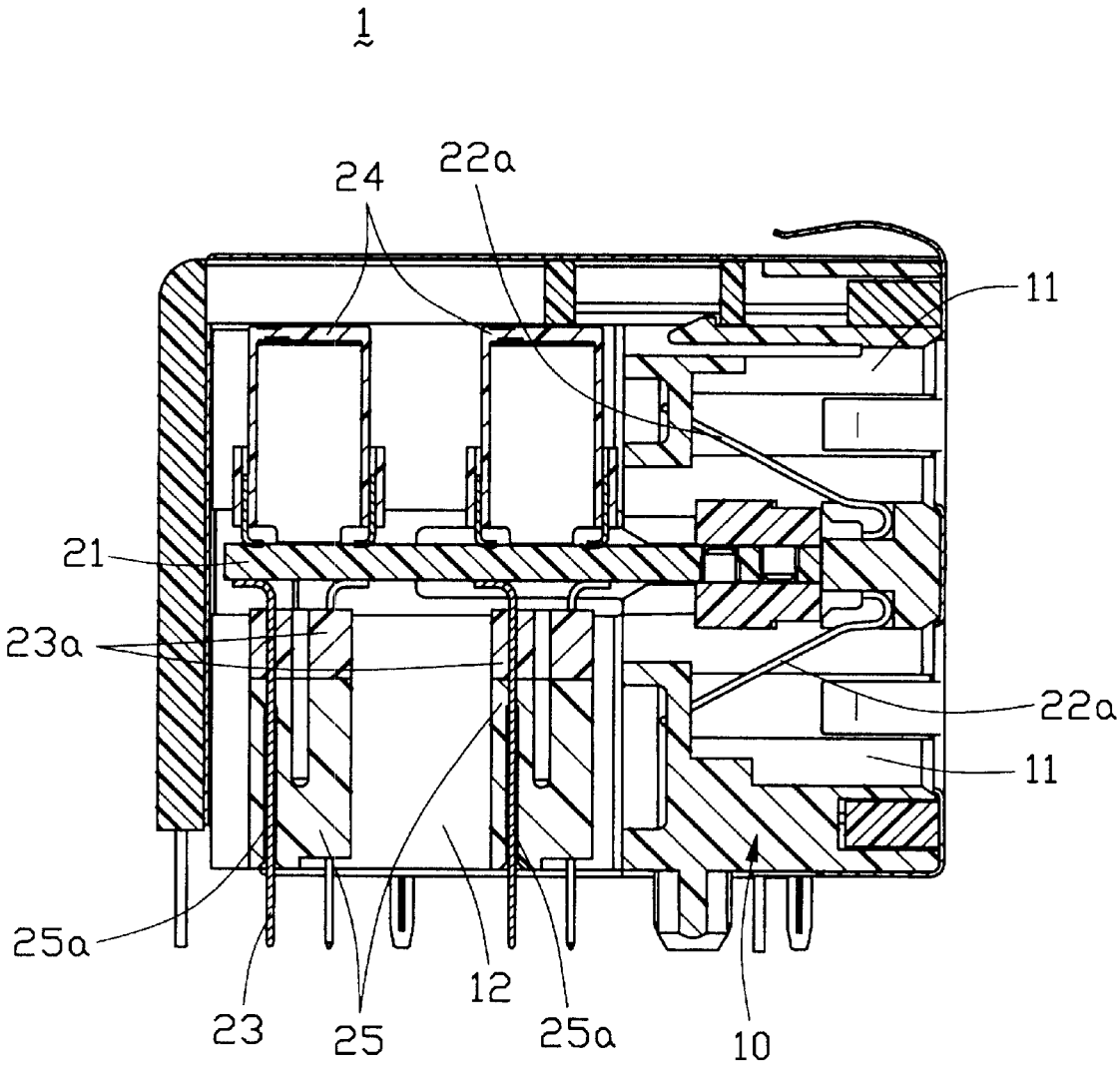
FIG. 2 is a cross sectional view of the electrical connector of FIG. 1.

Referring to FIGS. 1 and 2, a modular jack connector 1 in accordance with the present invention includes a housing 10 seated on a main printed circuit board (not shown) and defining two plug receiving spaces 11 for receiving a complementary plug connector (not shown) therein. The housing 10 further defines a rear space 12.

A terminal core 20 is arranged in the rear space 12. The terminal core 20 includes a printed circuit board 21 with a plurality of first terminals 22 mounted thereon. Each first terminal 22 includes a spring arm 22*a* extending into the plug receiving space 11 when the terminal core 20 is assembled to the housing 10. The core 20 further includes a plurality of second terminals 23 mounted on the other side of the printed circuit board 21. A pair of first noise suppressing devices 24 is mounted on the printed circuit board 21 and electrically connecting the first terminals 22 with the second terminals 23 via the printed circuit board 21. The first noise suppressing device 24 is a module in which a magnet with wire is included therein. This module is manufactured and distributed by Midcom, Inc, located in South Dakota, U.S. Accordingly, detailed description of the first noise suppressing device 24 is omitted for simplicity.

The second terminals 23 are integrally molded to an insulative base 23*a* so as to provide accurate footprint corresponding to the conductive pads on the printed circuit board 21 (not shown). On the other hand, the molded second terminals 23 provide easy manipulation, specially in mass production.

According to one aspect of the present invention, a pair of second noise suppressing devices 25 is provided to the second terminals 23 so as to provide enhanced noise suppressing performance. The second device 25 in accordance with the present invention is preferably made from ferrite ceramic with a plurality of holes 25*a* defined therein. The array of the holes 25*a* is designed with respect to the second terminals 23 and dimensioned such that the second terminals 23 are snugly fitted therein. By this arrangement, the second terminals 23 are substantially surrounded by the second device 25 thereby providing excellent noise suppressing performance.

In addition, it can be easily appreciated that the second terminals 23 are surrounded by a whole block instead of a single choke or magnet. It is understandably that the noise suppressing performance is enhanced and improved.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector comprising:

an insulative housing defining a complementary connector receiving space;

a terminal module retained to the housing, said terminal module including a first printed circuit board with a first set of terminals, on a front portion thereof, extending into the complementary connector receiving space;

a first noise suppression device mounted on the printed circuit board electrically connected to said first set of terminals;

a second set of terminals extending from the first printed circuit board toward a second printed circuit board on which the housing is seated, and electrically connected to said first set of terminals via said first noise means; and a second noise suppression device mechanically and electrically coupled with at least one set of said first and second sets of terminals; wherein said first noise suppression device and said second noise suppression device are aligned with each other in a vertical direction.

2. The connector as recited in claim 1, wherein the first noise suppression device is positioned on one surface of the printed circuit board while the second set of terminals is located on other surface thereof.

3. The connector as recited in claim 1, wherein said second noise suppression device is applied to the second set of terminals.

* * * * *